United States Patent [19]

Richter

[11] Patent Number: 5,069,752

[45] Date of Patent: Dec. 3, 1991

[54] DIGESTER SCREEN SWITCHING

[75] Inventor: Johan C. F. C. Richter, Oslo, Norway

[73] Assignee: Kamyr AB, Karlstad, Sweden

[21] Appl. No.: 516,519

[22] Filed: Apr. 30, 1990

[51] Int. Cl.[5] ..... D21K 7/14

[52] U.S. Cl. ..... 162/37; 162/39; 162/42; 162/59; 162/249; 162/251; 210/805

[58] Field of Search ..... 162/17, 19, 37, 39, 162/40, 41, 42, 57, 59, 237, 248, 249, 250, 251; 210/194, 805, 806

[56] References Cited

U.S. PATENT DOCUMENTS

| | | | |
|---|---|---|---|
| 2,217,732 | 10/1940 | Dean | 162/249 |
| 2,695,232 | 11/1954 | Richter | 162/251 |
| 4,517,053 | 5/1985 | Devine | 162/251 |
| 4,693,785 | 9/1987 | Laakso | 162/251 |
| 4,780,181 | 10/1988 | Lind | 162/37 |

*Primary Examiner*—Richard V. Fisher
*Assistant Examiner*—Todd J. Burns
*Attorney, Agent, or Firm*—Cushman, Darby & Cushman

[57] ABSTRACT

In a continuous digester for paper pulp (comminuted cellulosic material), abrupt variations in high pressure steam flow are minimized. First and second vertically spaced annular screens are provided in a vertical vessel. Each has an annular header associated with it and first and second circumferentially spaced liquid outlets associated with each header. The first outlet for the first screen is generally vertically in line with the first outlet for the second screen, and the second outlet of the first screen is generally vertically in line with the second outlet of the second screen. Simultaneous withdrawal of liquid from the first outlet of the first screen and the second outlet of the second screen takes place, and then is terminated, and then simultaneous withdrawal of liquid from the second outlet of the first screen and the first outlet of the second screen takes place, and then is terminated. This withdrawal sequence is repeated continously. Each header is divided into two substantially equal volumes by vertical walls with an outlet provided at the circumferential center of each volume. Any material that passes through the screens flows under the force of gravity from the vertical walls to the outlet associated with that header volume due to the provision of downwardly sloping bottom portions in each volume.

8 Claims, 2 Drawing Sheets

DIGESTER SCREEN SWITCHING

BACKGROUND AND SUMMARY OF THE INVENTION

In the continuous digestion of cellulosic fibrous material to produce paper pulp, it is important to have effective internal circulation of liquid in order to provide for even treatment of the pulp. This is typically accomplished in continuous digesters by utilizing screen girdles at specific levels within the digester, with liquid withdrawn from the screens being treated with high pressure steam to heat it, and then recirculated to central pipes extending vertically within the digester. In order to ensure that the screens do not clog up, it is necessary to switch between the screens every few minutes (e.g. three-five minutes).

In most commercial installations, the screens are typically provided in pairs, an upper screen and a lower screen. Each screen has a header associated therewith, and typically two outlets are provided from the header, at opposite sides of the vessel around the circumference thereof. In a typical commercial installation, withdrawal is effected from the upper screen for three-five minutes, and then terminated and withdrawal is effected from the lower screen for three to five minutes and then terminated, and the sequence is repeated continuously.

The commercial installations with the above-described referencing do provide for effective treatment of the pulp, however there is one drawback associated with such a sequencing. The sequencing results in abrupt variations in the high pressure steam flow, usually the high pressure steam flow peaking when switching to the upper screen takes place, and bottoming out when switching to the lower screen takes place. This abrupt variation in steam flow may upset steam generation in certain mills.

According to the present invention, a method and simple modifications to apparatus are provided which eliminate or minimize such abrupt variations in high pressure steam flow. According to the method of the present invention there is provided a method of withdrawing liquid from first and second vertically spaced annular screens in a vertical vessel in which material is treated utilizing high pressure steam, each having an annular header associated therewith and first and second circumferentially spaced liquid outlets associated with each header, the first outlet for the first screen being generally vertically in line with the first outlet for the second screen, and the second outlet of the first screen being generally vertically in line with the second outlet of the second screen; comprising the steps of sequentially: (a) Simultaneously withdrawing liquid from the first outlet of the first screen and the second outlet of the second screen. (b) Terminating the withdrawal in step (a). (c) Simultaneously withdrawing liquid from the second outlet of the first screen and the first outlet of the second screen. (d) Terminating the withdrawal in step (c). And, (e) repeating steps (a)–(d) with an appropriate frequency and so as to minimize abrupt variations in high pressure steam flow. The method preferably comprises the further step (f) of dividing each header into two substantially equal volumes, the circumferential center of each volume being one of the outlets associated with that header, so that liquid withdrawal from the header takes place from only about one half the total volume of the header at any given time. There also may be the further step (g) of causing any material that passes through the screens to flow under the force of gravity from the circumferential ends of each header volume to the outlet associated with that header volume. Step (g) is preferably accomplished by providing downwardly sloping bottom portions from each circumferential end of each volume to the outlet associated with that volume.

According to another aspect of the present invention a particular vertical continuous digester is provided. The digester has the following conventional elements: a vertical vessel having a material inlet at the top, and a material outlet at the bottom; high pressure steam supply means for facilitating treatment of the material in the vessel; first and second vertically spaced annular screens in the vertical vessel, each having an annular header associated therewith and first and second circumferentially spaced liquid outlets associated with each header, the first outlet for the first screen being generally vertically in line with the first outlet for the second screen, and the second outlet of the first screen being generally vertically in line with the second outlet of the second screen; and pump and valve means for selectively withdrawing liquid from the header outlets. According to the present invention there is also provided: vertical wall means for dividing each header into two approximately equal volumes, an outlet associated with that header being at the approximate circumferential center of each volume; and, downwardly sloping bottom portions associated with each volume, and extending from the wall means of each volume to the outlet associated with that volume, so that any material that passes through a screen will not settle at a wall, but will move toward the outlet associated with the volume which it is associated with. The downwardly sloping bottom portions are preferably false bottoms.

It is the primary object of the present invention to provide for the effective withdrawal of liquid from a continuous digester so as to minimize abrupt variations in high pressure steam flow. This and other objects of the invention will become clear from an inspection of the detailed description of the invention and from the appended claims.

DETAILED DESCRIPTION OF THE DRAWINGS

Figure 1:
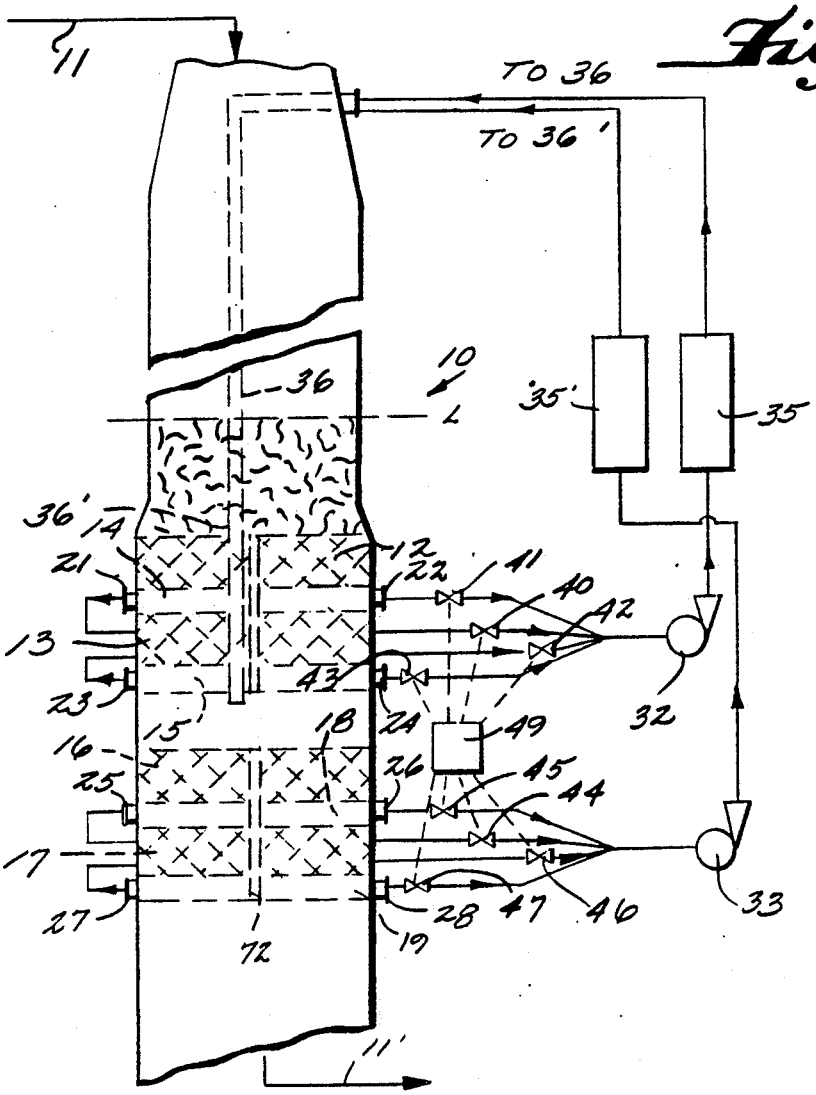
FIG. 1 is a side schematic view of an exemplary continuous digester according to the present invention.
Figure 2:
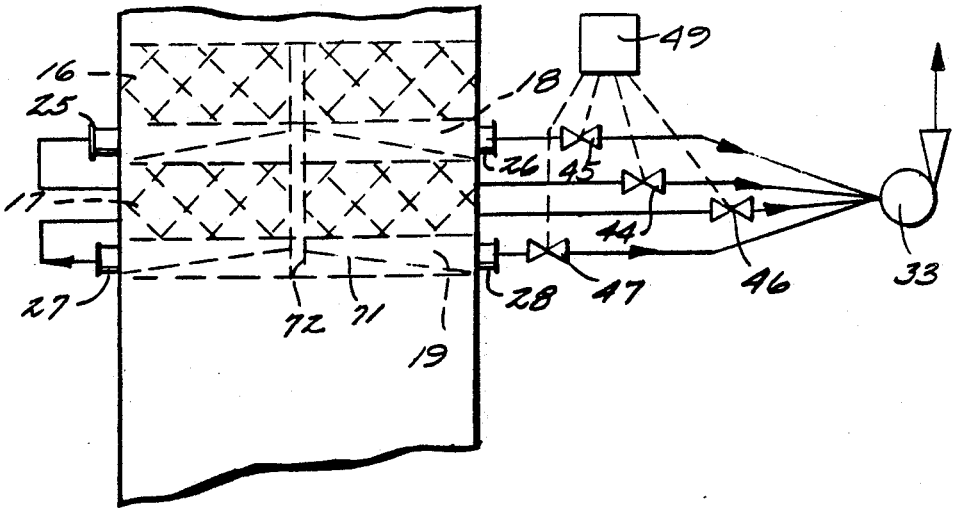
FIG. 2 is a side schematic detail view of a modification of the digester of FIG. 1.

An exemplary continuous digester (e.g. see U.S. Pat. No. 4,547,264) with which the switching system and method according to the present invention is employed is illustrated generally at 10 in the drawings, comprising a vertical vessel with material (chips) inlet 11 at the top, and an outlet 11' for treated material (cellulosic pulp) at the bottom. The digester includes a pair of vertically spaced annular screens 12, 13, disposed therein, each having an annular header 14, 15 associated therewith. Each header provides a substantially circumferentially continuous cavity. Preferably, a second pair of vertically spaced annular screens 16, 17 are also provided in the vessel 10, vertically spaced from the first pair of screens 12, 13, and having headers 18, 19 associated therewith.

According to the present invention, each annular header 14, 15, 18, 19 has first and second liquid outlets associated therewith, the liquid outlets being circumferentially spaced around the digester 10 (preferably spaced about 180° apart). First outlets 21, 23, 25 and 27 are associated with the headers 14, 15, 18, and 19, respectively, as are second outlets 22, 24, 26 and 28, respectively.

Means are provided for withdrawing liquid from the vessel 10, such means being operatively connected to each outlet 21 though 28. Such withdrawing means preferably takes the form of one or more pumps 32, 33. The pumps 32 and 33 are connected to means for heating the withdrawn liquid and returning it to the interior of the vessel 10, such means taking the form of conventional headers 35, 35' heated with high pressure steam and central distribution pipes 36, 36' for the upper and lower screen sets, respectively. There is further provided means for selectively providing withdrawal of liquid from a given outlet while preventing withdrawal from the other outlets. Such selective withdrawal providing means include a plurality of valves—such as solenoid controlled valves—40 through 47, one associated with each outlet 21 through 28, with a common electric control element 49 for selectively controlling operation of the valves 40 through 47 according to a predetermined sequence. During operation of the digester 10, cellulosic chip material preferably maintains a level L (see FIG. 1), chips being in contact with the screens 12, 13, 16 and 17 during operation in the vessel 10.

According to the method of the present invention, the controller 49 is operated to control the valves associated with each pair of screens—that is each set of an upper screen and lower screen—so as to control the valves 40 through 47 or the like associated therewith to obtain a particular sequencing. For example, the controller 49 controls the valves 45 and 46 so that they are open while the valves 44 and 47 are closed. After the pump 33 has withdrawn liquid through the valves 45 and 46 for a predetermined period of time—e.g. three-five minutes—the valves 45 and 46 are closed, and then the controller opens valves 44 and 47 and withdrawal takes place through them for three to five minutes.

The same sequence of operation may be provided for the upper set of screens 12, 13 too.

Figure 4:
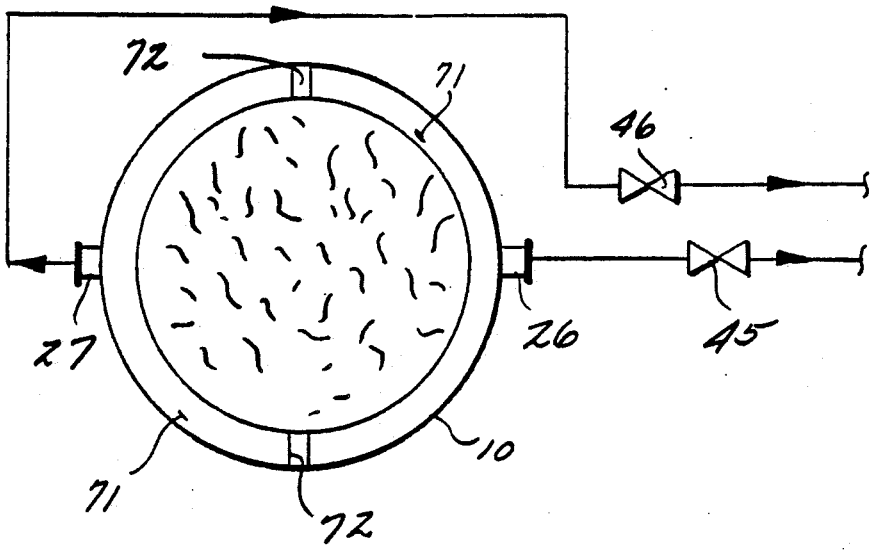
FIG. 4 is a horizontal cross-sectional view at one of the headers of the digester of FIG. 1.

There are two modifications to the conventional apparatus, such as shown in U.S. Pat. No. 4,547,264, that are desirable according to the present invention. The first is the provision of sloping bottom portions in each of the headers (14, 15, 18, 19). These are indicated by reference numeral 71. The second is the provision of vertical wall means 72 dividing each header into first and second volume, for example—as seen in FIG. 4—one volume associated with the outlet 27 and another associated with the outlet 26 for the header 19. The volumes are substantially equal and the outlets (e.g. 26, 27) are at approximately the circumferential center of the volumes.

Figure 3:
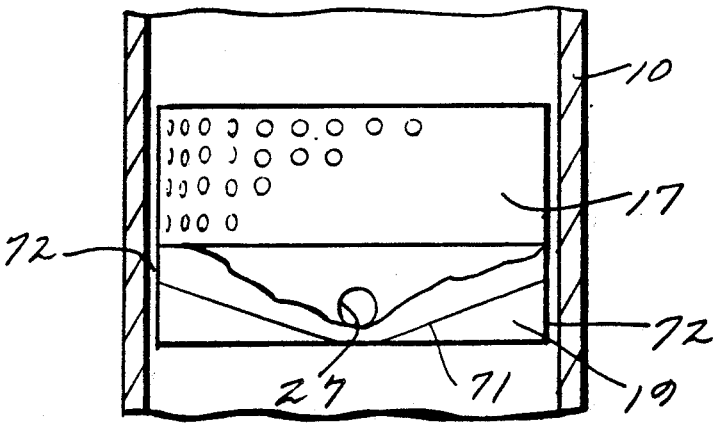
FIG. 3 is a longitudinal cross-sectional detail view showing the sloping bottom portions of one header volume.

The bottom portion 71—which preferably comprise false bottoms of the header (e.g. 19)—slope downwardly from each of the walls 72 to the circumferential center of the volume with which they are associated, at the respective outlet. For example, with respect to outlet 27, see the downwardly sloping bottom portion 71 of FIG. 3. The downwardly sloping bottom portions 71 ensure that if any material passes through the screens it will flow gravitationally from adjacent walls 72—where there is the least flow—toward the outlet (e.g. 27) associated with that volume.

It will thus be seen that according to the present invention it is possible to minimize abrupt variations in high pressure steam flow that normally occur as a result of withdrawal through the upper screens and then withdrawal through the lower screens. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of withdrawing liquid from first and second vertically spaced annular screens in a vertical vessel in which material is treated utilizing high pressure steam, each having an annular header associated therewith and first and second circumferentially spaced liquid outlets associated with each header, the first outlet for the first screen being generally vertically in line with the first outlet for the second screen, and the second outlet of the first screen being generally vertically in line with the second outlet of the second screen; comprising the steps of sequentially:

(a) simultaneously withdrawing liquid from the first outlet of the first screen and the second outlet of the second screen;

(b) terminating the withdrawal in step (a);

(c) simultaneously withdrawing liquid from the second outlet of the first screen and the first outlet of the second screen;

(d) terminating the withdrawal in step (c); and (e) repeating steps (a)-(d) with an appropriate frequency and so as to minimize abrupt variations in high pressure steam flow.

2. A method as recited in claim 1 comprising the further step (f) of dividing each header into two substantially equal volumes, the circumferential center of each volume being one of the outlets associated with that header, so that liquid withdrawal from the header takes place from only about one half the total volume of the header at any given time.

3. A method as recited in claim 2 wherein steps (a)-(f) are practiced during the digestion of comminuted cellulosic fibrous material.

4. A method as recited in claim 3 comprising the further step (g) of causing any material that passes through the screens to flow under the force of gravity from the circumferential ends of each header volume to the outlet associated with that header volume.

5. A method as recited in claim 4 wherein step (g) is accomplished by providing downwardly sloping bottom portions from each circumferential end of each volume to the outlet associated with that volume.

6. A method as recited in claim 2 comprising the further step (g) of causing any material that passes through the screens to flow under the force of gravity from the circumferential ends of each header volume to the outlet associated with that header volume.

7. A method as recited in claim 6 wherein step (g) is accomplished by providing downwardly sloping bottom portions from each circumferential end of each volume to the outlet associated with that volume.

8. A method as recited in claim 1 wherein steps (a) and (c) are each practiced for about three-five minutes each.

* * * * *